United States Patent [19]

Cranston, III et al.

[11] Patent Number: 4,697,510

[45] Date of Patent: Oct. 6, 1987

[54] CONTAMINATION DEFLECTOR SYSTEM FOR BALE BINDING MACHINES

[75] Inventors: Albert E. Cranston, III, Wilsonville; Mark L. Kudlicka, Lake Oswego, both of Oreg.

[73] Assignee: Cranston Machinery Co., Inc., Oak Grove, Oreg.

[21] Appl. No.: 944,171

[22] Filed: Dec. 22, 1986

[51] Int. Cl.[4] ..... B65B 13/06

[52] U.S. Cl. ..... 100/14; 100/26

[58] Field of Search ..... 100/25, 26, 14, 912, 100/916, 53; 104/107; 198/860.3; 254/403; 57/121

[56] References Cited

U.S. PATENT DOCUMENTS

| | | | |
|---|---|---|---|
| 3,179,037 | 4/1965 | Cranston, Jr. et al. | 100/31 |
| 3,387,556 | 6/1968 | Cranston, Jr. et al. | 100/31 |
| 3,613,556 | 10/1971 | Curight | 100/14 |
| 3,768,396 | 10/1973 | Colemann | 100/26 |
| 4,406,219 | 9/1983 | Mosca | 100/26 X |
| 4,464,997 | 8/1984 | Dehne | 104/107 X |
| 4,520,720 | 6/1985 | Urban et al. | 100/26 |

*Primary Examiner*—Werner H. Schroeder
*Assistant Examiner*—Andrew M. Falik
*Attorney, Agent, or Firm*—Lee R. Schermerhorn

[57] ABSTRACT

A bale binding machine for waste material has a bale encircling guide track for a band to bind the bale wherein the bottom portion of the guide track under the bale is provided with a pair of deflectors to intercept contaminating liquids and solids falling from the bale and prevent contamination of the guide track.

7 Claims, 5 Drawing Figures

CONTAMINATION DEFLECTOR SYSTEM FOR BALE BINDING MACHINES

BACKGROUND OF THE INVENTION

This invention relates to a deflector system to prevent contamination of the bottom band guide track in a bale binding machine for baling solid waste materials having escaping contaminants.

Such waste materials usually include metal cans such as beer and soda pop cans and municipal waste containing some liquid. Such liquids drip into the bottom guide track of the binding machine and result in contamination problems in the entire machine as the liquids and solid matter carried thereby are carried around the guide track and congeal in many parts of the strapping system. The bottom side of the guide track is usually in a position to catch such liquids dripping out of the end of the baling press. Dust or small solid particles may also contaminate the bottom track.

In order to keep the binding machine in good operating condition, there is a need to prevent such contamination of the guide track.

SUMMARY OF THE INVENTION

The present invention involves the provision of deflectors to intercept and deflect contaminating materials dripping down toward the bottom guide track. The deflectors are resilient to yield to the stripping of the band from the guide track and do not interfere with the operation of the binding machine.

In the preferred embodiment illustrated and described herein, an upper yieldable inclined deflector mounted on one side of the guide track intercepts and diverts most of the falling contaminants, and a lower deflector mounted on the opposite side of the guide track intercepts and deflects any falling contaminants which may escape the upper deflector. The guide track is also provided with drain holes to prevent the accumulation of liquids in the guide track.

The present improvements may be applied to the binding machines in the Cranston, Jr. et al. U.S. Pat. Nos. 3,179,037 and 3,387,556.

The invention will be better understood and additional features and advantages will become apparent from the following description of the preferred embodiment illustrated in the accompanying drawings. Various changes may be made however, in the details of construction and arrangement of parts and certain features may be used without others. All such modifications within the scope of the appended claims are included in the invention.

DESCRIPTION OF THE PREFERRED EMBODIMENT

Figure 1:
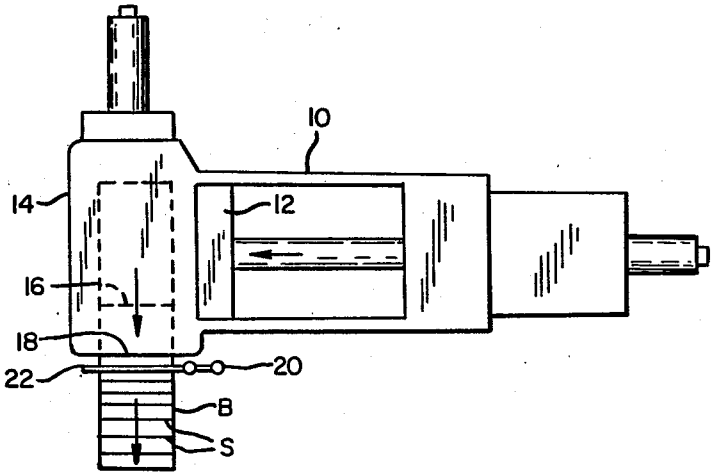
FIG. 1 is a top plan view showing how the binding machine is applied to the baling press.

In FIG. 1, waste material placed in the charging hopper 10 is pushed by ram 12 between lower and upper platens in the bale press 14. After compression of the waste material the compressed bale B of material is pushed by ram 16 through a press discharge opening 18. The present binding machine 20 has a guide track 22 surrounding the bale as it emerges from the press opening at 18.

Ram 16 pushes the bale in intermittent movements so that bands or straps S may be applied around the bale at 6 inch to 12 inch intervals spaced along the length of the bale. The strapping S may be wire or a flat band, metallic or nonmetallic. In wire strapping the ends of the wire band may be joined by twisting to form a so-called knot, or they may be joined by a fastener or welded together. When a flat band is used the ends may be connected together by clip notches, by welding or any other type of joint.

Figure 2:
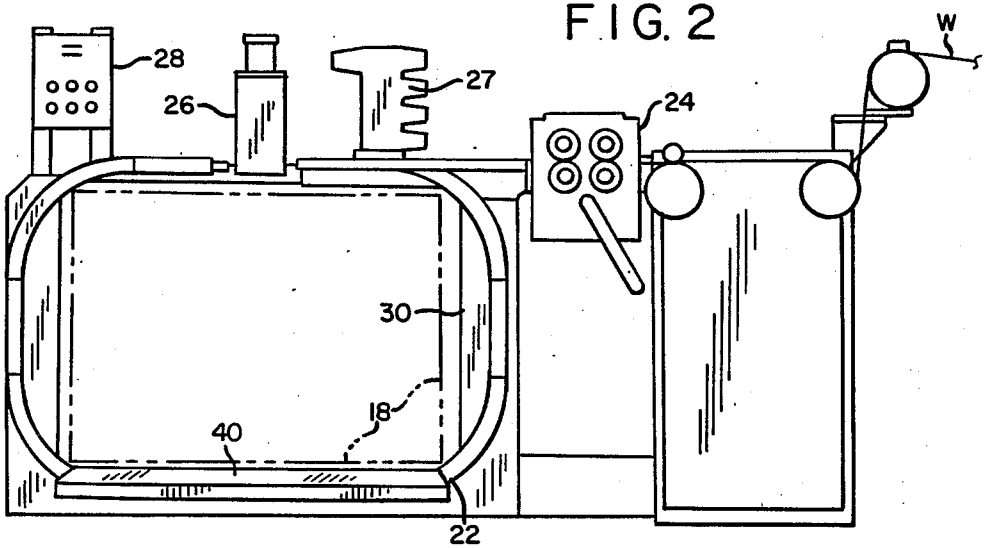
FIG. 2 is an elevation view showing the relationship between the binding machine and the press discharge opening.

In the illustrated embodiment, as seen in FIG. 2, the strapping S in FIG. 1 is wire which is formed in a loop around press opening 18 by the wire guide track 22. The wire is pushed around the guide track by a wire drive 24, and the ends of the wire are secured together by a knotter 26 and conventional wire grippers. Various binding operations actuated by hydraulic valves 27 are automatic in response to the incremental movements of the bale out of the baling press 14 supplemented by an operator's control panel 28.

Figure 3:
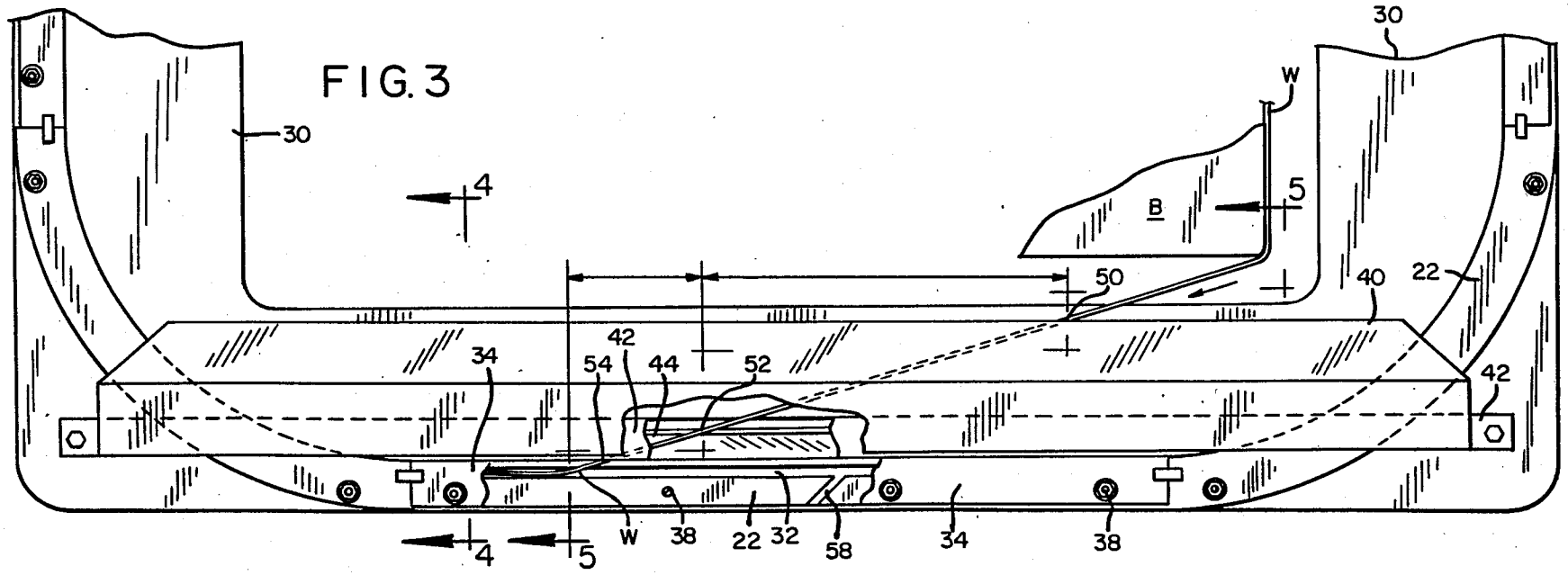
FIG. 3 is an enlarged elevation view with parts broken away, showing the bottom guide track of the bale binding machine.
Figure 4:
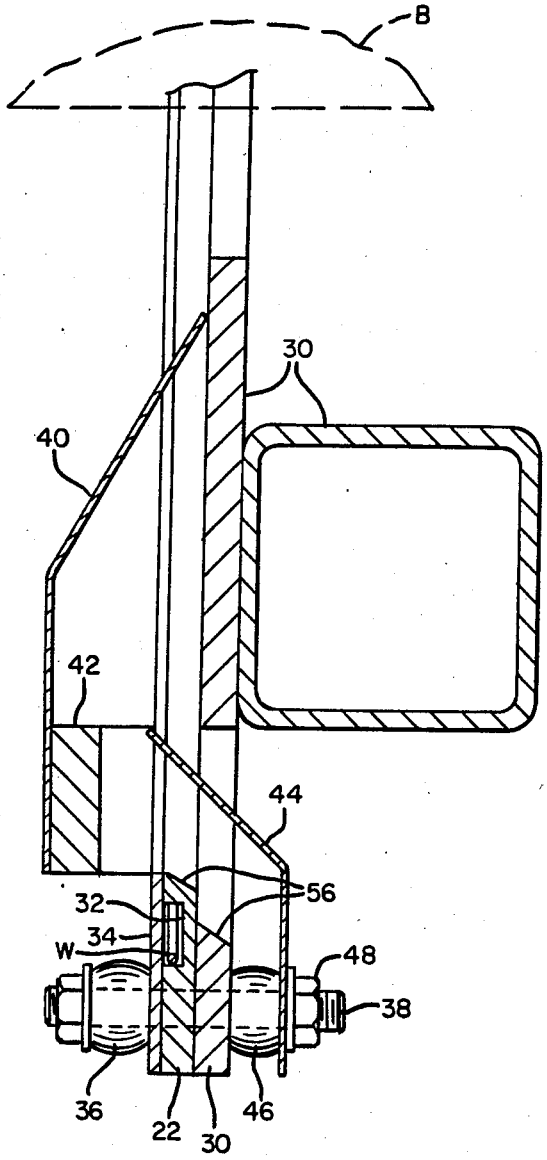
FIG. 4 is a view on the line 4—4 in FIG. 3.
Figure 5:
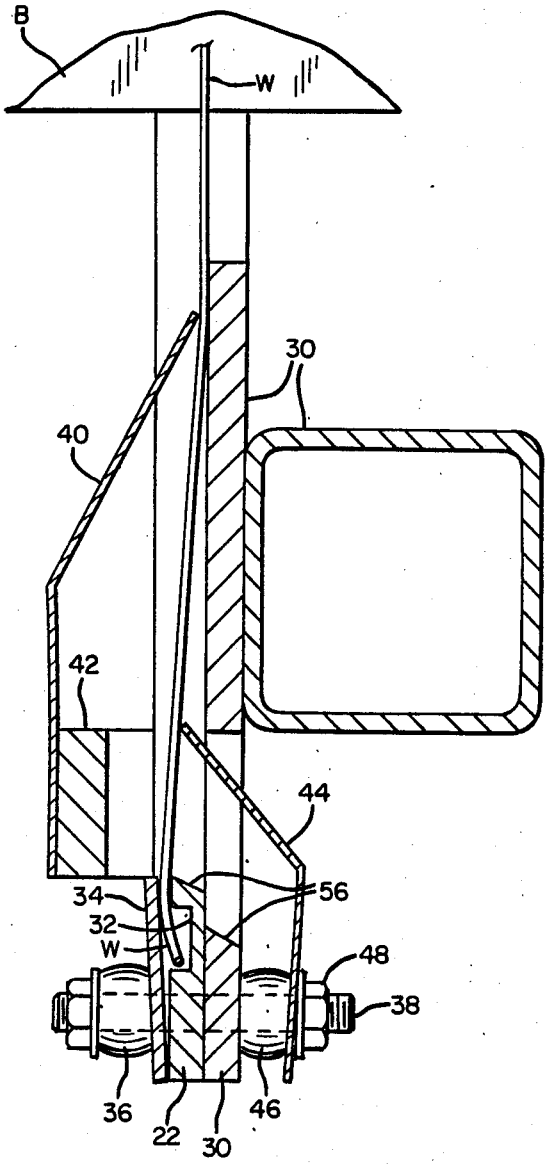
FIG. 5 is a view on the line 5—5 in FIG. 3.

Wire guide track 22 is carried by a rectangular frame 30 as shown in FIGS. 3, 4 and 5. Along the lower side of frame 30 which is under the bale B as it emerges from the press 14, the guide track 22 has a lateral recess or groove 32 to receive the wire W as it is pushed around the guide track by wire drive 24. The wire is normally retained in this groove by a yieldable cover plate 34 clamped against the face of the guide track 22 by rubber bushings 36 on bolts 38, which secure the guide track 22 to its supporting frame 30. The present invention is not limited to this specific configuration of guide track.

After the wire W has been pushed entirely around the guide track to encircle the bale B, in a counterclockwise direction in FIG. 2, its leading end is secured by a gripper in or adjacent the knotter 26 and the wire drive 24 is reversed to strip the wire out of its guide track in a clockwise direction and tension it around the bale. The stated directions of wire feed and wire stripping may be reversed if desired. The construction and operation of the parts which perform these described functions are illustrated and described in detail in the said Cranston, Jr. et al. U.S. Pat. No. 3,179,037.

As the wire is stripped out of groove 32 it deflects the cover plate 34 as shown in FIG. 5, momentarily forming a funnel to receive any liquid or dirt which may be present or in the process of falling onto the guide track. Such liquid and dirt accumulating in groove 32 is carried around the guide track by successive wires, contaminating not only the guide track but also the knotter and gripper mechanisms above the bale and even the wire drive 24 when the wire feed is reversed to tighten a wire loop about a bale.

In the present improvement an upper contamination deflector 40 has an inclined upper portion with its top edge bearing resiliently against frame plate 30 above the guide track 22. The lower portion of deflector 40 is mounted on a bar 42 above and spaced forward from guide track 22. As shown in FIG. 4, this prevents any liquid or solid material from falling on or into the guide track. When the wire is being stripped from the guide track it moves deflector 40 outward momentarily in the region of the wire as the wire moves along the upper edge of the deflector as shown in FIG. 5. This is only a momentary movement of the deflector and it immediately returns to its FIG. 4 position to intercept any falling liquid or solid material.

As a further safeguard against contamination in the lower guide track, a second deflector 44 is also provided. This deflector has an upper portion inclined outward away from the plate 30 in the opposite direction from the inclination of deflector 40. The upper portion of deflector 44 normally overhangs the guide track as shown in FIG. 4. The lower side of deflector 44 is pressed by rubber bushings 46 against nuts 48 on bolts 38 to hold the deflector in its FIG. 4 position, to intercept any contamination which may have escaped past the upper deflector 40.

The wire stripping action momentarily tilts lower deflector 44 clockwise during passage of the wire, and then the deflector immediately returns to its FIG. 4 position by the action of resilient bushings 46.

As seen in FIG. 3, the point of contact at 50 between upper deflector 40 and wire W is never immediately over the point of contact 52 between lower deflector 44 and the wire. The wire emerging from the guide track at 54 is disposed at such an angle that the points 50 and 52 are not close to each other, whereby any material falling through the gap at 50 between upper deflector 40 and guide track frame plate 30 is rather remote from the major deflection of lower deflector 44 where it is engaged by the wire at 52, and even more remote from the momentary gap at 54. Both plates 40 and 44 and also guide track cover plate 34 are sufficiently resilient that the deflections of their upper edges shown in FIG. 5 do not extend a substantial distance along the deflector plate.

In the wire stripping action the wire contact points 50, 52 and 54 move rapidly clockwise, right to left in FIG. 3. As previously stated, this direction of stripping may be reversed.

As an additional precaution the top surfaces of guide track 22 and frame 30 are inclined at 56 as seen in FIGS. 4 and 5 to shed and avoid accumulation of any loose materials falling thereon. Also, guide track 22 has grooves 58 at intervals as seen in FIG. 3, forming drain holes to drain out any liquid in the wire groove 32.

What is claimed is:

1. In a binding machine for binding bales containing escaping contaminating materials, a guide track extending under and around the bale to guide a band around the bale for binding the bale, said guide track being normally closed but arranged to open for stripping the band out of the guide track when the band is tightened around the bale, a pair of resilient contamination deflectors extending along the bottom portion of the guide track extending under the bale, said deflectors comprising a lower deflector mounted on one side of the guide track and having an upper free edge portion inclined over said bottom portion of the guide track, and an upper deflector mounted on the opposite side of said bottom portion of the guide track and having an upper free edge portion inclined in the opposite direction over the guide track and over said lower deflector.

2. The invention of claim 1, said lower deflector being mounted on the side of said guide track approached by the bale entering the binding machine.

3. The invention of claim 1, said lower deflector being mounted on bolts with resilient clamping means to make the deflector resilient for the stripping movement of the band.

4. The invention of claim 1 including drain holes in said guide track.

5. The invention of claim 1, said bottom portion of the guide track having an inclined top surface to shed contaminating materials falling thereon.

6. The invention of claim 1, said band being stripped out of said bottom portion of the guide track at a small angle from horizontal whereby the moving point of contact of the band with the lower deflector is at a distance horizontally from the moving point of emergence of the band from the guide track, and the moving point of contact of the band with the upper deflector is at a distance horizontally from both said point of contact with said lower deflector and said point of emergence from the guide track.

7. A bale binding machine for waste or recycled material having a bale encircling guide track for a band to bind the bale, and a resilient upstanding deflector inclined over the bottom portion of the guide track under the bale to intercept and deflect contaminating materials falling from the bale.

* * * * *